US010396462B2

(12) United States Patent
Chopra

(10) Patent No.: US 10,396,462 B2
(45) Date of Patent: Aug. 27, 2019

(54) C-BAND CONFORMAL ANTENNA USING MICROSTRIP CIRCULAR PATCHES AND METHODS THEREOF

(71) Applicant: Wipro Limited, Bangalore (IN)

(72) Inventor: Prateek Chopra, New Delhi (IN)

(73) Assignee: Wipro Limited, Bangalore (IN)

( * ) Notice: Subject to any disclaimer, the term of this patent is extended or adjusted under 35 U.S.C. 154(b) by 264 days.

(21) Appl. No.: 15/463,917

(22) Filed: Mar. 20, 2017

(65) Prior Publication Data

US 2018/0254559 A1 Sep. 6, 2018

(30) Foreign Application Priority Data

Mar. 3, 2017 (IN) ..... 201741007511

(51) Int. Cl.
*H01Q 9/04* (2006.01)
*H01Q 3/26* (2006.01)
*H01Q 21/20* (2006.01)

(52) U.S. Cl.
CPC ..... *H01Q 9/0407* (2013.01); *H01Q 3/2617* (2013.01); *H01Q 9/0485* (2013.01); *H01Q 21/20* (2013.01)

(58) Field of Classification Search
CPC ..... H01Q 9/0407; H01Q 21/20; H01Q 3/2617
See application file for complete search history.

(56) References Cited

U.S. PATENT DOCUMENTS 6,061,025 A 5/2000 Jackson et al.
6,292,144 B1 9/2001 Taflove et al.
2017/0054545 A1* 2/2017 Negus ..... H04L 5/1423

OTHER PUBLICATIONS

Chopra et al. "Conformal antenna using Circular Microstrip patches in C band"; 2016 3rd International Conference on Signal Processing and Integrated Networks (SPIN); Date of Conference: Feb. 11-12, 2016; DateAdded to IEEE Xplore: Sep. 15, 2016 (Year: 2016).*
Chopra, et al., "Design of an X-Band Conformal Antenna Using Microstrip Patches", IEEE, 2015, pp. 83-87.

* cited by examiner

*Primary Examiner* — Ricardo I Magallanes
(74) *Attorney, Agent, or Firm* — Pepper Hamilton LLP

(57) ABSTRACT

A conformal antenna includes a dielectric substrate. A plurality of circular micro strip antenna patches are arranged on the dielectric substrate and coupled to a coaxial feed circuit. The conformal antenna is configured to operate in a frequency range of about 4.0 GHz to about 8.0 GHz. A method of designing a conformal antenna is also disclosed.

13 Claims, 11 Drawing Sheets

C-BAND CONFORMAL ANTENNA USING MICROSTRIP CIRCULAR PATCHES AND METHODS THEREOF

This application claims the benefit of Indian Patent Application Serial No. 201741007511, filed Mar. 3, 2017, which is hereby incorporated by reference in its entirety.

FIELD

This technology relates to a conformal antenna and methods of designing a conformal antenna, more specifically, the present technology relates to a C-band conformal antenna using micro strip circular patches and methods thereof.

BACKGROUND

Commonly used convex objects utilized in antenna design create a number of problems including unwanted reflection of the signal, large size of the antenna design, and spurious radiations. While conformal antennas have been utilized to solve these problems, conformal antenna design can be improved to match the growing need for such antennas. Specifically, the fast changing technology and the role of digitization of services have increased the demand for small, light-weight, and efficient antennas. Thus, it is necessary to design conformal antennas that solve prior problems related to signal reflection, the large size of prior antenna systems, and spurious radiations, while still maintaining comparable gain, a compact design, and minimum interference with the surroundings.

SUMMARY

A conformal antenna is disclosed herein, which includes a plurality of circular micro strip antenna patches that are arranged on a dielectric substrate and coupled to a coaxial feed circuit. The disclosed conformal antenna is configured to operate in a frequency range of about 4.0 GHz to about 8.0 GHz (C-band).

A method of designing a conformal antenna includes selecting, by an antenna design management computing device, a dielectric substrate. A desired operating frequency range for the conformal antenna is selected. The desired operating frequency is in a range of about 4.0 GHz to about 8.0 GHz. A circular micro strip antenna patch is designed based on at least a dielectric constant, a height of the dielectric substrate, and the desired operating frequency. The circular micro strip antenna patch is configured to conform to the shape of the dielectric substrate. A number of the circular micro strip antenna patches to be applied on the dielectric substrate is determined based on at least the surface area of the dielectric substrate and the surface area of the circular micro strip antenna patch.

DETAILED DESCRIPTION

Figure 1:
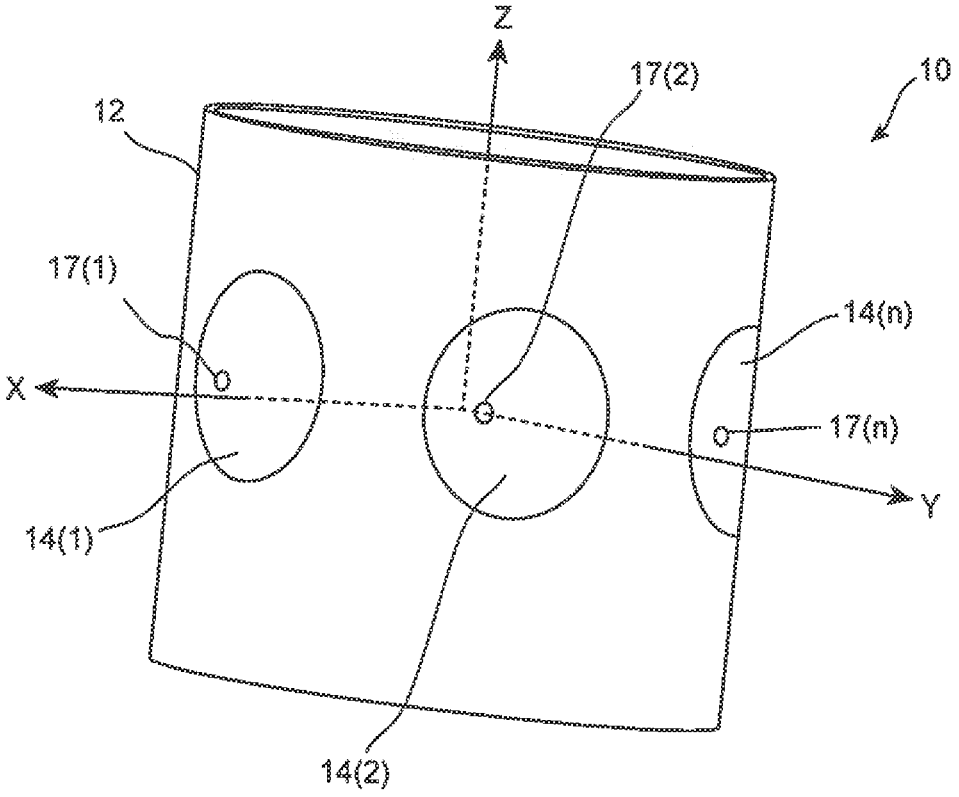
FIG. 1 is a front view of an exemplary conformal antenna of the present technology.

An exemplary conformal antenna 10 is illustrated in FIGS. 1-3B. In this particular example, the conformal antenna may include a dielectric substrate 12, a plurality of circular micro strip antenna patches 14(1)-14(*n*), a coaxial feed circuit 16, an antenna control computing device 18, a summation circuit 20, a frequency controller circuit 22, an adaptive filter 24, and a feedback loop, highlighted as dotted box 26 in the FIG. 3A, including a synchronous circuit 28 and an error estimation circuit 30. In an implementation, the conformal antenna 10 may include other types and numbers of elements, devices, or components in other configurations. In this example, the conformal antenna 10 may be configured to operate in a C-band frequency range of about 4.0 GHz to about 8.0 GHz, although other frequency ranges may be utilized in other applications. Use of the C-band frequency makes the conformal antenna 10 less susceptible to outside interference and allows the conformal antenna to be utilized for commercial purposes. The C-band frequency is also able to withstand adverse weather conditions. The conformal antenna 10 may include system architecture for both signal transmission and signal reception.

This technology provides a more compact and efficient conformal antenna that may advantageously be utilized in a number of commercial applications. The conformal antenna provides comparable gain as compared to large planar antennas. The conformal antenna further provides reduced interference, a good voltage standing wave ratio (VSWR), and a wide beam width with a wide area view angle. The conformal antenna of the present technology resolves direction problems related to other antenna technologies.

Figure 2:
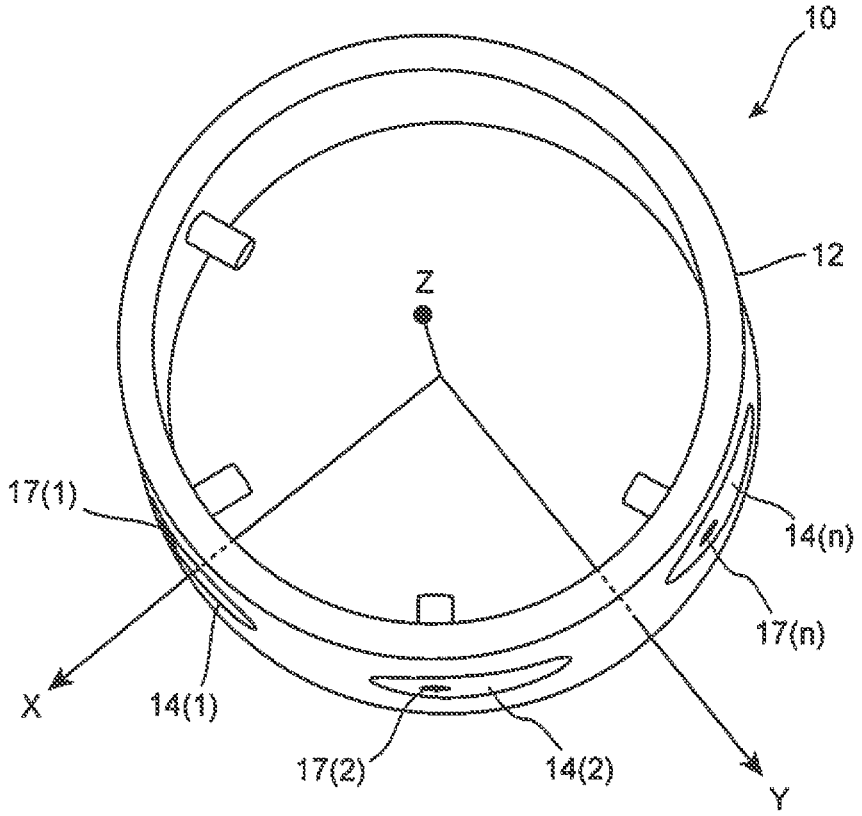
FIG. 2 is a top view of the exemplary conformal antenna.

Referring now more specifically to FIGS. 1 and 2, in this example, the dielectric substrate 12 may be cylindrical in shape with a hollow center, although the dielectric substrate 12 may have other shapes such as spherical or conical, by way of example only. The dielectric substrate 12 may be formed of any dielectric material suitable for the application for which the conformal antenna 10 is to be utilized. In one example, a high frequency laminate material, such as RT/Duroid® made by Rogers Corporation, Rogers, Conn. may be utilized for the dielectric substrate 12, although other dielectric substrates 12 such as quartz or alumina may also be utilized in an alternate example. The material for the dielectric substrate 12 may be chosen to provide a desired dielectric constant required for the specific application. The material for the dielectric substrate 12 may further be selected to limit the amount of spurious emissions at the desired frequency operating range. The height of the dielectric substrate 12 may also be chosen to limit spurious emissions and to maintain a compact design for the conformal antenna 10.

The plurality of circular micro strip antenna patches **14(1)-14(*n*) may be arranged on a surface of the dielectric substrate 12. In one example, the plurality of circular micro strip antenna patches 14(1)-14(*n*) may be smart skin antennas. The plurality of circular micro strip antenna patches 14(1)-14(*n*) may be configured to conform to the surface of the dielectric substrate 12 and may be located at various points on the surface of the dielectric substrate 12 depending on the design of the conformal antenna 10 as discussed in further detail below. Any number of circular micro strip antenna patches 14(1)-14(*n*) may be utilized depending on the size of the dielectric substrate 12 and the desired application. By way of example, the number of circular micro strip antenna patches 14(1)-14(*n*) may be determined based on the available surface area on the dielectric substrate 12 and the desired beam width of the conformal antenna 10. In one example, the plurality of circular micro strip antenna patches 14(1)-14(*n*) are arranged on the dielectric substrate 12 to provide a beam width of 360 degrees to the conformal antenna 10. In another example, the plurality of circular micro strip antenna patches 14(1)-14(*n*) are arranged in a micro strip array (MSA) on the surface of the dielectric substrate 12. In one example, the plurality of circular micro strip antenna patches 14(1)-14(*n*) may be photo etched on the dielectric substrate 12, although other methods may be utilized to arrange the plurality of circular micro strip antenna patches 14(1)-14(*n*) on the dielectric substrate 12. Each of the plurality of circular micro strip antenna patches 14(1)-14(*n*) may include a corresponding coaxial feed probe 17(1)-17(*n*) thereon for connection to the coaxial feed circuit 16** as described below.

Figure 3A:
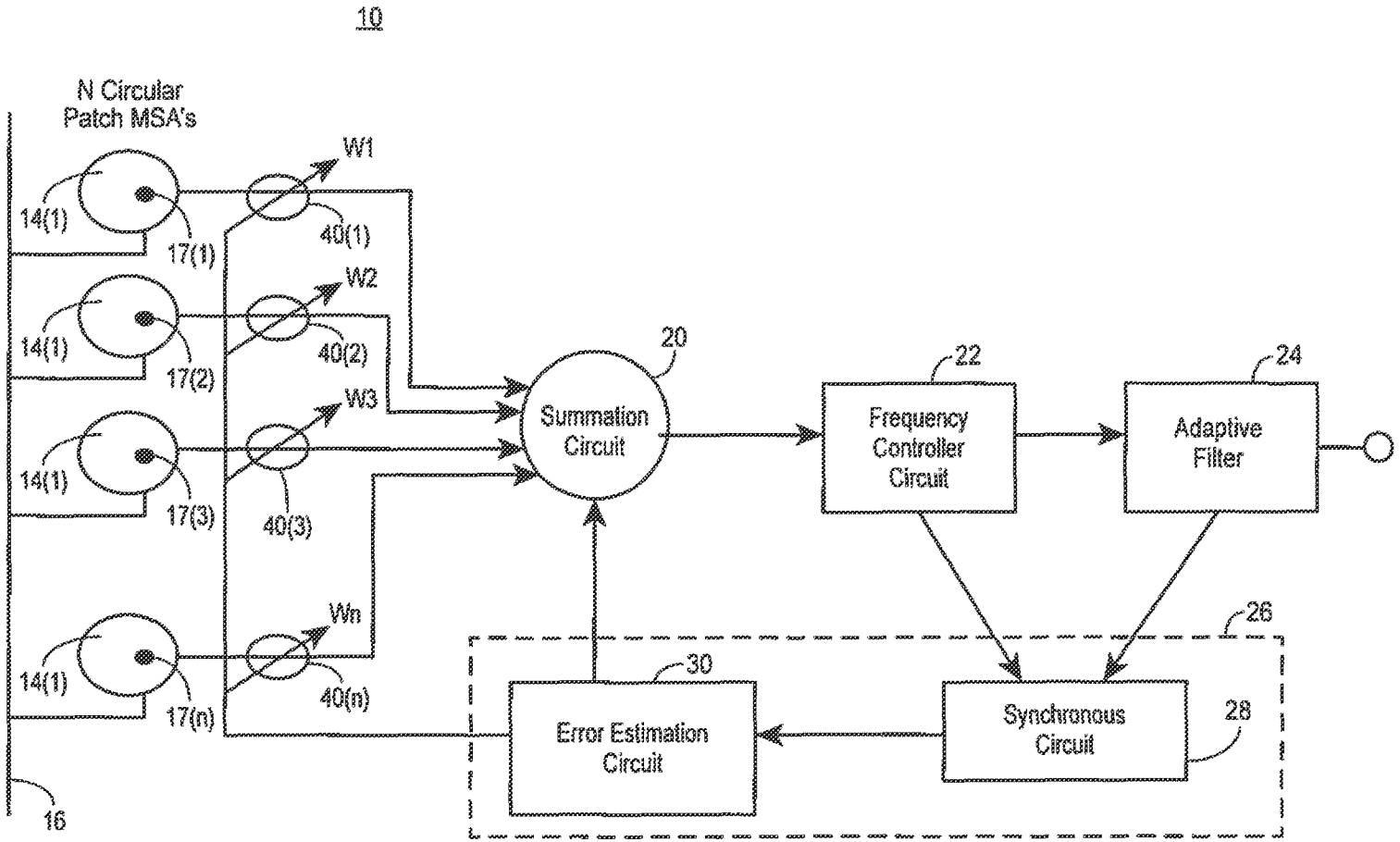
FIG. 3A is a schematic view of the exemplary conformal antenna.

Referring now more specifically to FIG. 3A, each of the plurality of circular micro strip antenna patches **14(1)-14(*n*) may be coupled to the coaxial feed circuit 16, although other types of feed circuits may be employed. The coaxial feed circuit 16 may provide for signal matching to allow for maximum power from the conformal antenna 10. The coaxial feed circuit 16 may provide a coaxial feed line to each of the plurality of circular micro strip antenna patches 14(1)-14(*n*) through a coaxial feed probe 17(1)-17(*n*) located on each of the plurality of circular micro strip antenna patches 14(1)-14(*n*)**.

Figure 3B:
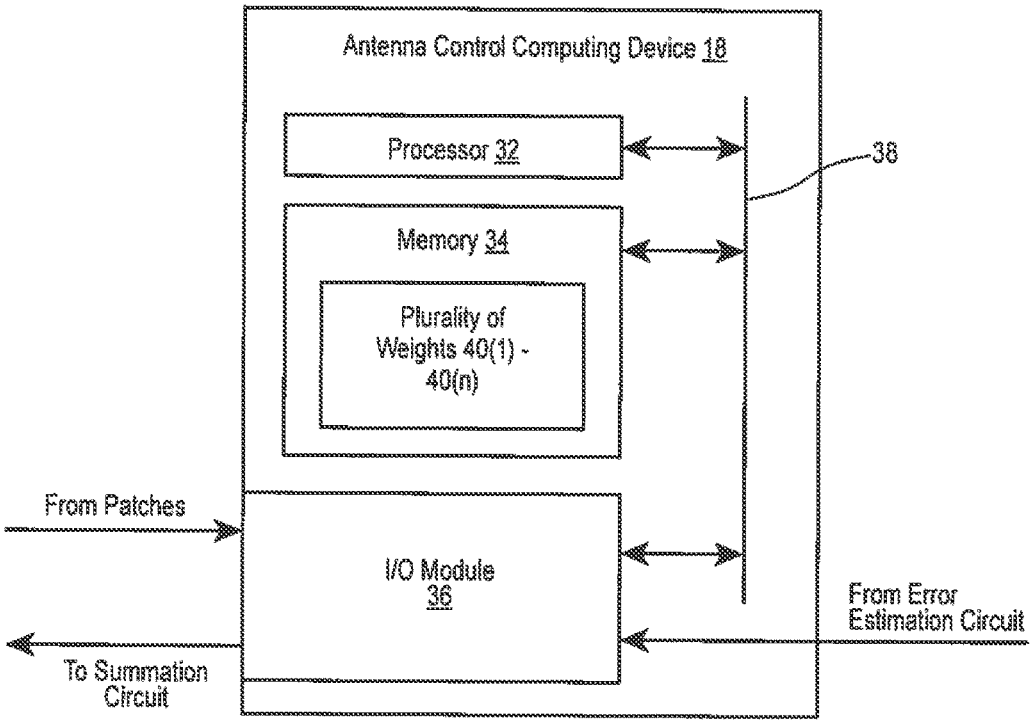
FIG. 3B is a block diagram of an exemplary antenna control computing device that may be utilized with the conformal antenna illustrated in FIG. 3A

Referring now more specifically to FIG. 3B, conformal antenna 10 may be coupled to the antenna control computing device 18. In one example, antenna control computing device 18 may be coupled to the conformal antenna 10 through electrical circuitry located on the conformal antenna 10. In another example, the electrical circuitry may be located on and be integral to a PCB that holds one or more elements of the conformal antenna 10 and antenna computing device 18, although the electrical circuitry may be located on a separate chip or board. Various signal conditioning elements known in the art, such as an amplifier or a capacitor, or converters, may be located between the conformal antenna 10 and the antenna control computing device 18 to provide an adjusted signal. In one example, the antenna control computing device 18 may be a microcontroller, although other types of computing devices may be utilized.

In one example, the antenna control computing device 18 may include a processor 32, a memory 34, and an input/output (I/O) module 36, all of which are coupled together by bus (shown as line 38 in the FIG. 3B) or other link, although other numbers and types of components, parts, devices, systems, and elements in other configurations and locations can be used.

The processor 32 in antenna control computing device 18 can execute a program of stored instructions for one or more aspects of the present invention as described and illustrated by way of the embodiments described herein, although the processor 32 could execute other numbers and types of programmed instructions. The processor 32 in the antenna control computing device 18 may include one or more central processing units or general purpose processors with one or more processing cores, for example.

The memory 34 in the antenna control computing device 18 may store these programmed instructions for one or more aspects of the present invention as described and illustrated herein, although some or all of the programmed instructions could be stored and/or executed elsewhere. A variety of different types of memory storage devices, such as a random access memory (RAM) or a read only memory (ROM) in the system or a floppy disk, hard disk, CD ROM, DVD ROM, or other computer readable medium which is read from and/or written to by a magnetic, optical, or other reading and/or writing system that is coupled to the processor 32, can be used for the memory 34 in the antenna control computing device 18. In this example, the memory 34 stores a plurality of weights **40(1)-40(*n*) that may be applied to an output signal from one or more of the plurality of circular micro strip antenna patches 14(1)-14(*n*). In this example, the processor 32 is configured to assign each of the plurality of weights 40(1)-40(*n*) to a corresponding one of the plurality of circular micro strip antenna patches 14(1)-14(*n*) for balancing a signal received from each of the plurality of circular micro strip antenna patches 14(1)-14(*n*)** to generate a weight-adjusted signal, as described in further detail below.

The I/O module 36 in the antenna control computing device 18 may provide an interface between the antenna control computing device 18 and the conformal antenna 10 through electrical circuitry. The I/O module 36 may be coupled to one or more additional elements such as an analog to digital converter and/or a digital to analog converter, by way of example only.

Referring again to FIG. 3A, the summation circuit 20 may be coupled to the antenna control computing device 18 for receiving weight-adjusted signals from the antenna control computing device 18. The summation circuit 20 may be configured to sum the weight-adjusted signals received from the antenna control computing device and to output a summed signal. Summation circuits known the in the art of conformal antennas may be utilized.

The frequency controller circuit 22 may be coupled to the summation circuit 20 to receive the summed signal from the summation circuit 20. The frequency controller circuit 22 can be configured to provide an output signal limited to a desired frequency range. In this example, the frequency controller circuit 22 is configured to provide an output signal in a frequency range of about 4.0 GHz to about 8.0 GHz, although the frequency controller circuit 22 may be configured to output signals in other frequency ranges. Frequency controller circuits known in the art of conformal antennas may be utilized.

The adaptive filter 24 may be coupled to the frequency controller circuit 22 to receive the output signal from the frequency controller circuit 22 at the desired frequency range. The adaptive filter 24 may be configured to apply one or more adaptive algorithms known in the art to output a first portion of the output signal as the output from the conformal antenna 10 and to provide a second portion of the output signal to the feedback loop 26.

In this example, the feedback loop 26 may include the synchronous circuit 28 coupled to the error estimation circuit 30, although the feedback loop 26 may include other types and numbers of elements or devices in other combinations. The synchronous circuit 28 may be coupled to both the frequency controller circuit 22 and the adaptive filter 24 to receive outputs therefrom. The synchronous circuit 28 may be coupled the error estimation circuit 30 to provide an output based on the clock signal in the synchronous circuit 28 to the error estimation circuit 30. The error estimation circuit 30 may be coupled to the summation circuit 20 and the antenna control computing device 18. The error estimation circuit 30 may be configured to provide adjustments to the summation circuit 20 and the plurality of weights 40(1)-40(*n*) stored in the memory 34 of the antenna control computing device 18 to improve the output of the conformal antenna 10 in further cycles as described in further detail below.

An exemplary operation of the conformal antenna 10 of the present technology will now be described with reference to FIGS. 1-4. Additional operation steps known in the art, such as necessary analog to digital or digital to analog conversions known in the art will not be described herein. Although the operation is described in the transmission-line mode, the conformal antenna 10 of the present technology may also be utilized as a receiving antenna.

In one example, each of the plurality of plurality of circular micro strip antenna patches 14(1)-14(*n*) may receive an input signal from the coaxial feed circuit 16. The plurality of circular micro strip antenna patches 14(1)-14(*n*) may output patch output signals in response to the received input signals.

Next, the patch output signals may be provided to the antenna control computing device 18 through the I/O module 36, although other microcontroller devices may receive the patch output signals. The processor 32 in the antenna control computing device 18 may apply the plurality of weights 40(1)-40(*n*) stored in the memory 34 to the patch output signals to generate weighted patch output signals in order to balance the patch output signals for the required signal strength and amount of signal required for the particular application for the conformal antenna.

Antenna control computing device 18 may output the weighted patch output signals through the I/O module 36 to the summation circuit 20. The summation circuit 20 may receive the weighted patch output signals from the antenna control computing device 18 and sum the weighted patch output signals to generate a summed signal. The summation circuit 20 may output the summed signal to the frequency controller circuit 22.

The frequency controller circuit 22 may receive the summed signal from the summation circuit 20. The frequency controller circuit 22, in this example, can be configured to restrict the summed signal received to the C-band frequency range from about 4.0 GHz to about 8.0 GHz, although the frequency controller circuit 22 may be utilized to restrict the summed signal to other frequency bands. The frequency controller circuit 22 may provide an output signal to the adaptive filter and an output signal to the synchronous circuit 28 to be inserted into the feedback loop 26.

The adaptive filter 24 may receive the output signal from the frequency controller circuit 22 and apply one or more adaptive algorithms known in the art to the first output signal. The adaptive filter 24 may provide an output signal to the output of the conformal antenna 10 and an output signal to the synchronous circuit 28 as part of the feedback loop 26. In one example, the adaptive filter 24 may be provided by one or more adaptive algorithms stored in the memory 34 of the antenna control computing device 18.

The synchronous circuit 28 may receive the output signal from the frequency controller circuit 22 and the output signal from the adaptive filter 24. The synchronous circuit 28 may apply, by way of example only, a clock signal to the output signals from the frequency controller circuit 22 and the adaptive filer 24 to provide a synchronized output signal to the error estimation circuit 30.

The error estimation circuit 30 may receive the synchronized output signal from the synchronous circuit 28 and determine necessary adjustments to the plurality of weights 40(1)-40(*n*) or to the summation circuit 20. The error estimation circuit 30 may provide an error correction output to the summation circuit 20 to compensate for any weight issues at the summation circuit 20. The error estimation circuit 30 may also provide an error correction output to the antenna control computing device 18 to provide information regarding adjustments that need to be made to the plurality of weights 40(1)-40(*n*) stored in the memory 34 of the antenna control computing device 18. The use of the feedback loop 26 assists in getting a stable output signal for the conformal antenna 10 at the required signal strength.

Figure 4:
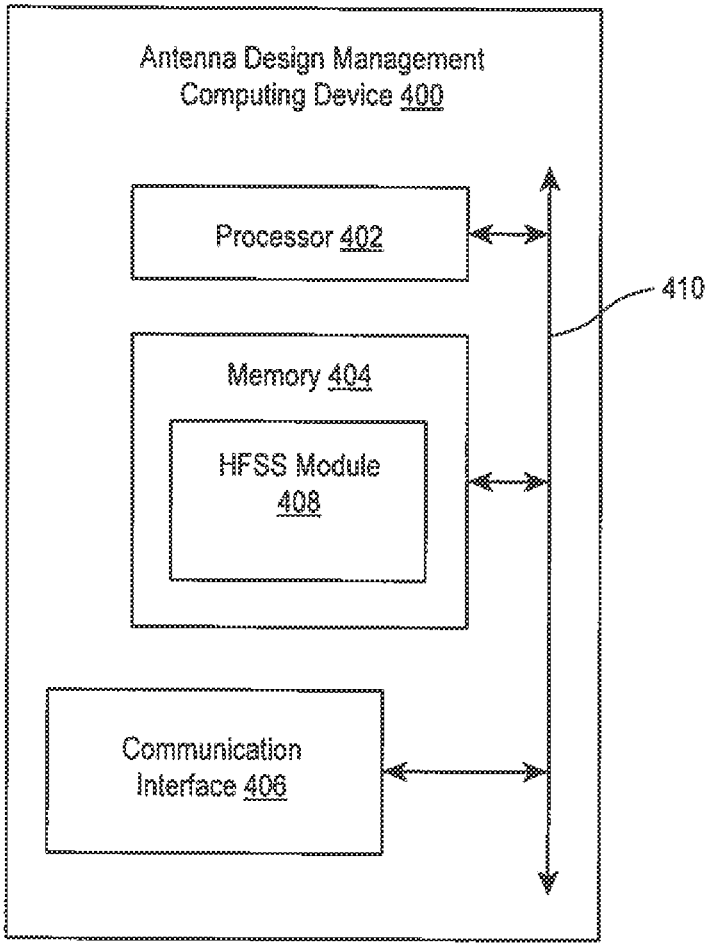
FIG. 4 is a block diagram of an antenna design management computing device of the present technology.

The present technology also relates to a method of designing a conformal antenna using an antenna design management computing device 400. The antenna design management computing device 400 is illustrated in FIG. 4. Referring more specifically to FIG. 4, the antenna design management computing device 400 in this particular example can include one or more processor(s) 402, a memory 404, and a communication interface 406, which are coupled together by a bus (shown as line 410 in the FIG. 4) or other communication link, although the antenna design management computing device 400 can include other types and/or numbers of physical and/or virtual systems and/or processors, devices, components, and/or other elements in other configurations.

The processor(s) 402 of the antenna design management computing device 400 can execute one or more programmed instructions stored in the memory 404 for designing a conformal antenna as illustrated and described in the examples herein, although other types and/or numbers of instructions can also be performed. The processor(s) 402 may include one or more central processing units and/or general purpose processors with one or more processing cores, for example.

The memory 404 of the antenna design management computing device 400 may store the programmed instructions executed by the processor(s) 402 as well as other data for one or more aspects of the present technology as described and illustrated herein, although some or all of the programmed instructions could be stored and executed elsewhere. A variety of different types of memory storage devices, such as a random access memory (RAM), read only memory (ROM), flash, solid state drives (SSDs), or other computer readable medium which is read from and written to by a magnetic, optical, or other reading and writing system that is coupled to the processor(s) 402, can be used for the memory 404.

In this particular example, the memory 404 includes a High Frequency Structural Simulator (HFSS) module 408 that may allow for theoretical design of the conformal antenna using a transmission-line model, although the memory 404 can also include other data, modules, or applications in other examples.

The communication interface 406 of the antenna design management computing device 400 may operatively couple and communicate with additional devices (not shown) over one or more communication network(s). By way of example only, the communication network(s) can include local area network(s) (LAN(s)) or wide area network(s) (WAN(s)), and can use TCP/IP over Ethernet and industry-standard protocols, although other types and numbers of protocols and/or communication networks can be used. The communication network(s) in this example can employ any suitable interface mechanisms and network communication technologies including, for example, teletraffic in any suitable form (e.g., voice, modem, and the like), Public Switched Telephone Network (PSTNs), Ethernet-based Packet Data Networks (PDNs), combinations thereof, and the like.

In addition, two or more computing systems or devices can be substituted for any one of the systems or devices in any example. Accordingly, principles and advantages of distributed processing, such as redundancy and replication also can be implemented, as desired, to increase the robustness and performance of the devices, apparatuses, and systems of the examples. The examples may also be implemented on computer system(s) that extend across any suitable network using any suitable interface mechanisms and traffic technologies, including by way of example only teletraffic in any suitable form (e.g., voice and modem), wireless traffic media, wireless traffic networks, cellular traffic networks, G3 traffic networks, Public Switched Telephone Network (PSTNs), Packet Data Networks (PDNs), the Internet, intranets, and combinations thereof.

The examples also may be embodied as one or more non-transitory computer readable media having instructions stored thereon for one or more aspects of the present technology as described and illustrated by way of the examples herein, as described herein, which when executed by one or more processors, cause the processors to carry out the steps necessary to implement the methods of this technology as described and illustrated with the examples herein.

Figure 5:
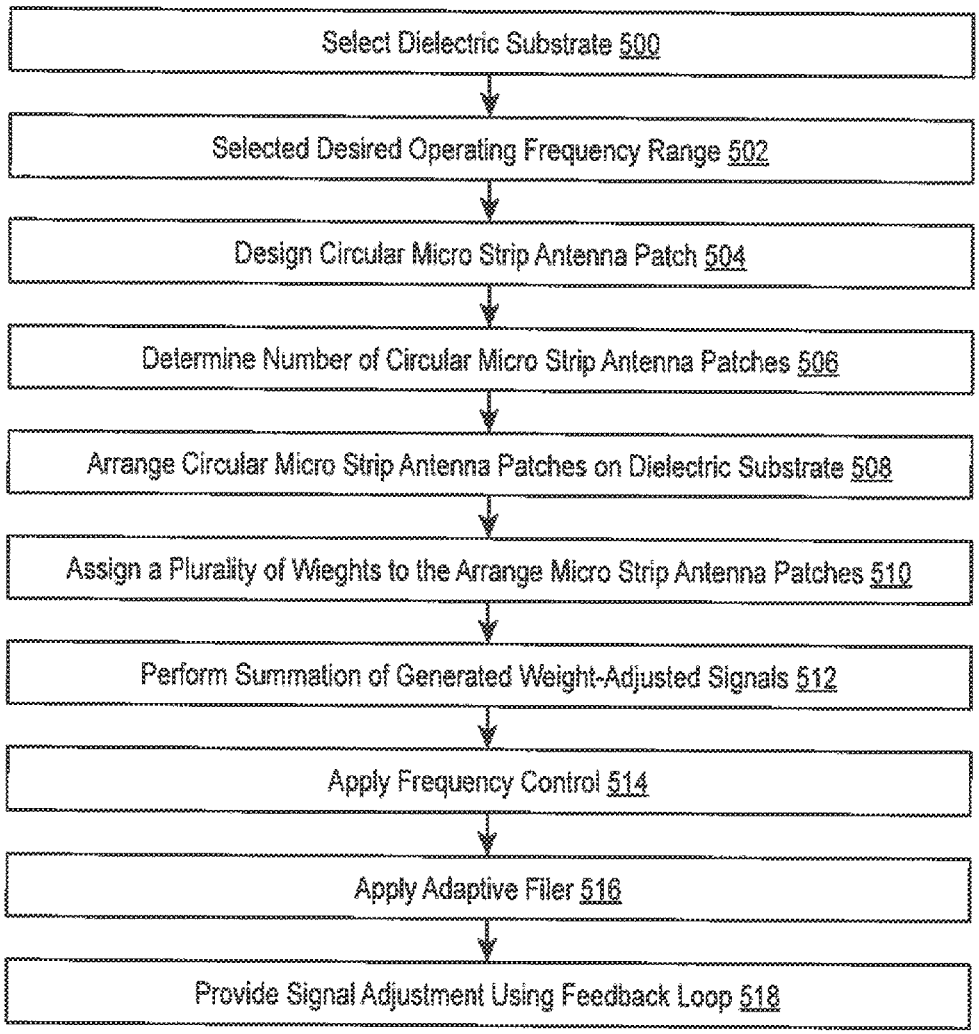
FIG. 5 is a flowchart of an exemplary method of designing a conformal antenna in accordance with the present technology.

An example of a method for designing a conformal antenna will now be described with reference to FIGS. 4-5.

First, in step 500 the antenna design management computing device 400 may select a dielectric substrate. In another example, the dielectric substrate may be input into the antenna design management computing device 400. In one example, the dielectric substrate may be spherical, cylindrical, or conical in shape, although the substrate could have other types of shapes. Suitable dielectric materials may be utilized and may be chosen, by way of example, based on their dielectric constant, although other types of factors may be used in the selection process. One or more dimensions of the selected dielectric substrate, such as the height of the dielectric substrate are determined based on an optimization performed by simulating the conformal antenna characteristics for minimizing spurious radiations, by way of example, although other conformal antenna properties may be optimized through the selection of the dimensions of the conformal antenna.

Next, in step 502, a desired operating frequency range for the conformal antenna may be selected. The desired operating frequency may be determined by the antenna design management computing device 400 based on the desired application, or may be selected by a user. In one example, the desired operating frequency may be in a range of about 4.0 GHz to about 8.0 GHz. In another example, the desired operating resonance frequency may be about 5.8 GHz.

In step 504, a circular micro strip antenna patch may be designed based on at least the dielectric constant, the height of the dielectric substrate, as well as the desired operating frequency as selected in step 502. The circular micro strip antenna patch may be configured to conform to the shape of the dielectric substrate. In one example, the plurality of circular micro strip antenna patches may be smart skin antennas. In this example, the circular micro strip antenna patch may be designed using the transmission line mode in the HFSS module 408 stored in the memory 404 of the antenna design management computing device 400 assuming a coaxial feed probe, although other theoretical design models may be employed. Specifically, the radius of the circular micro strip antenna patches may be determined and optimized based on at least one dimension, such as the height of the selected dielectric substrate, the dielectric constant of the dielectric substrate, and the operating frequency selected. In one example, each of the plurality of circular micro strip antenna patches may have an optimized effective radius of about 9.5 mm.

Next, in step 506 a determination of a number of the circular micro strip antenna patches to be applied on the dielectric substrate can be made based on at least the surface area of the dielectric substrate and the surface area of the circular micro strip antenna patch designed in step 504.

In step 508, a plurality of the circular micro strip antenna patches may be arranged on the dielectric substrate. In one example, the plurality of circular micro strip antenna patches are arranged to provide a beam width of 360 degrees to the conformal antenna. In another example, the plurality of circular micro strip antenna patches are arranged in a micro strip array (MSA) on the surface of the dielectric substrate. The theoretical design may then be tested using the HFSS module 408. The conformal antenna design may be optimized in the theoretical design to obtain the features necessary based on the desired application.

In one example, the theoretical design may be performed using the HFSS module 408. First, a theoretical micro strip antenna can be formed using the following specifications, by way of example only: the ground plate/boundary may be selected as Perfect E. The substrate can be Rogers RT/duroid 5880, having a dielectric constant of 2.2. The patches may be selected to have a boundary of a Perfect E and a radius as determined in step 504 as described above. The probe can have an inner probe cylinder that is set as a perfect conductor, a middle probe cylinder of Teflon, and an outer probe cylinder set as a perfect conductor. The probe may be designed in the HFSS module 408 to provide a coaxial feed. The model can be designed to have a wave port to provide the feed.

The theoretical antenna design generated using the HFSS module 408 with the specifications set forth above may be then utilized in a simulation over the resonance frequency for which the antenna is designed. In this example, the resonant frequency can be the C-band range from about 4.0 GHz to about 8.0 GHz. The results of the simulations may be recorded to determine a number of antenna parameters based on the simulation.

Next, the theoretical micro strip antenna design can be utilized to form a theoretical conformal antenna using the HFSS module 408, in which the theoretical micro strip antenna provides the foundation of the conformal antenna. A conformable shape, such as a cylinder or sphere may be selected in the HFSS module 408. The specifications utilized above for the theoretical micro strip antenna design can be utilized with the patches residing on the outer surface of the selected shape. The simulation may then performed for the designed conformal antenna and the results can be recorded. The process may be repeated with additional antenna elements while keeping a defined element spacing and angle between the elements. Antenna parameters such as gain, bandwidth, and beam width, for example, may be recorded at the resonant frequency.

Next, the number of patches to be used on the theoretical conformal antenna can be determined. The angular distance between two patches in the theoretical design created using the HFSS module 408 may be calculated in radians. The arc length between the two patches may then be calculated based on the resonant frequency. The arc length in turn may allow for a determination of the radius of the patch to be utilized. The number of elements to be placed on the conformal antenna can then be selected. The number of patches may be selected to provide a 360 degree view for the conformal antenna.

Next, using the theoretical conformal antenna design from step 508, in step 510 a plurality of weights may be assigned to a corresponding one of the plurality of circular micro strip antenna patches for balancing the signal received from each of the plurality of circular micro strip antenna patches to generate a weight-adjusted signal corresponding to each of the plurality of circular micro strip antenna patches. In one example, the plurality of weights may be assigned by the antenna design management computing device 400 to test the theoretical model. In another example, the plurality of weights may be applied by another computing device, such as the antenna control computing device 18 as described above.

In step 512, a summation may be performed of the generated weight-adjusted signals. In one example, the antenna design management computing device 18 may perform the summation. In another example, the summation may be performed by a summation circuit that receives the generated weight-adjusted signals, such as the summation circuit 20 described above.

In step 514, a frequency control may be applied. In one example, the frequency control may be configured to provide an output signal in the frequency range of about 4.0 GHz to about 8.0 GHz. In one example, the frequency control may be applied by the antenna design management computing device 400 in the theoretical model. Alternatively, the frequency control may be provided by a frequency control circuit, such as frequency control circuit 22 as described above.

Next, in step 516 an adaptive filter may be utilized to apply one or more adaptive algorithms to output a first portion of the output signal and to provide a second portion of the output signal to a feedback loop. In one example, the adaptive filter may be applied by the antenna design management computing device 400 in the theoretical model. Alternatively, the adaptive filter may be provided by an adaptive filter circuit, such as the adaptive filter 24 as described above.

In step 518, adjustments may be provided to the output signal based on a feedback loop. In one example, the feedback loop may be applied by the antenna design management computing device 400 in the theoretical model. Alternatively, a feedback loop such as feedback loop 26 as described above may be provided.

Example 1—Conformal Antenna

A conformal antenna designed using the methods of the present technology has 0.5 GHz of bandwidth and a beam width of 153.03600. The conformal antenna further has a gain of 2.1846 dB with a left lobe gain of 0.7794 dB and a right lobe gain of 1.0289 dB as only four elements are used.

Figure 6:
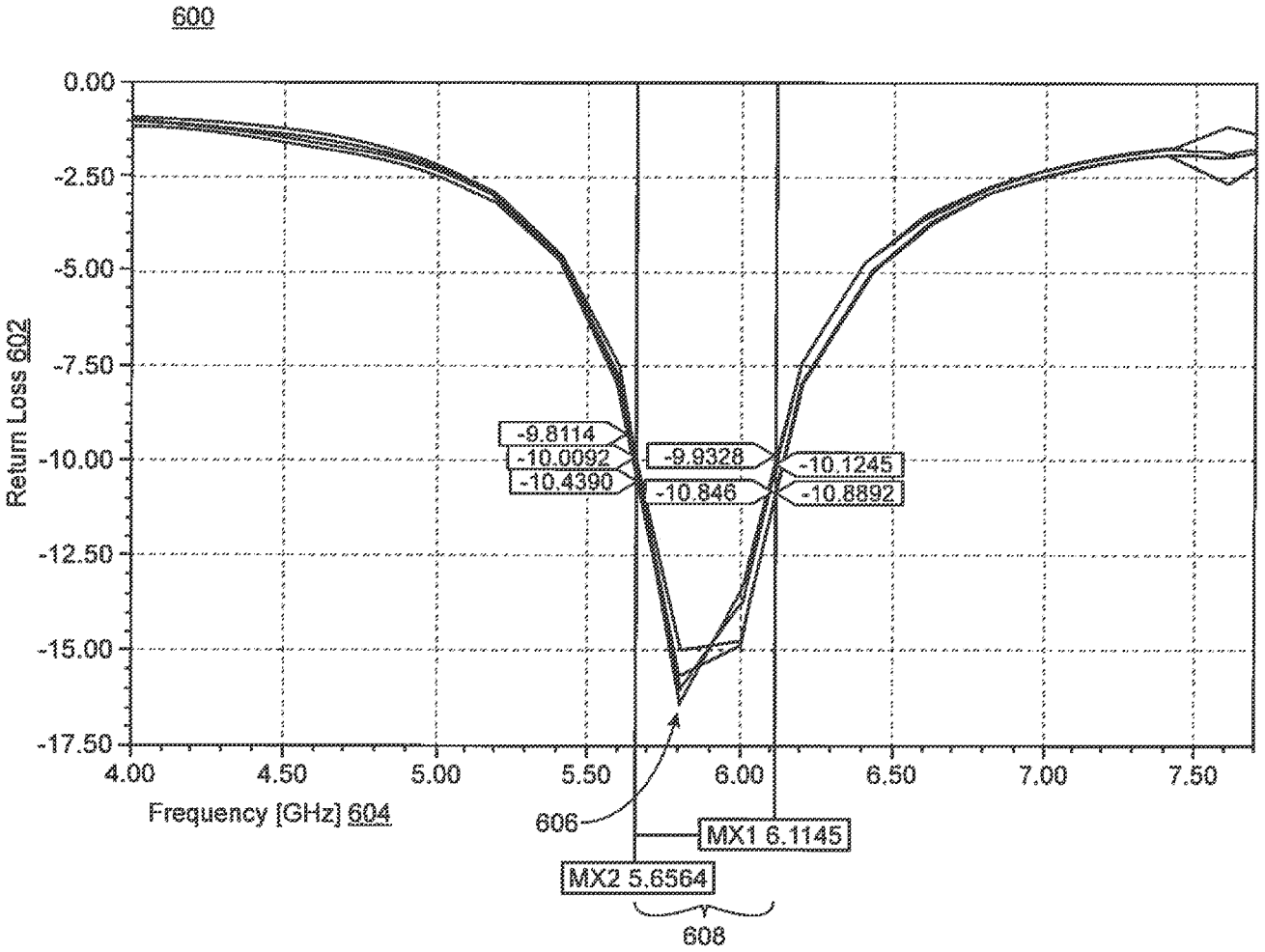
FIG. 6 displays a return loss versus frequency plot for an exemplary conformal antenna of the present technology.

FIG. 6 displays a chart 600 plotting return loss 602 versus frequency 604 for an exemplary conformal antenna designed using the methods of the present technology. The conformal antenna provides a maximum return loss 606 of −16.50 dB and a bandwidth 608 of 0.4581 GHz making the conformal antenna a narrow bandwidth antenna with lower insertion loss. The lower insertion loss and narrow bandwidth provide a conformal antenna for which signal quality will not be depleted from outside interferences.

Figure 7:
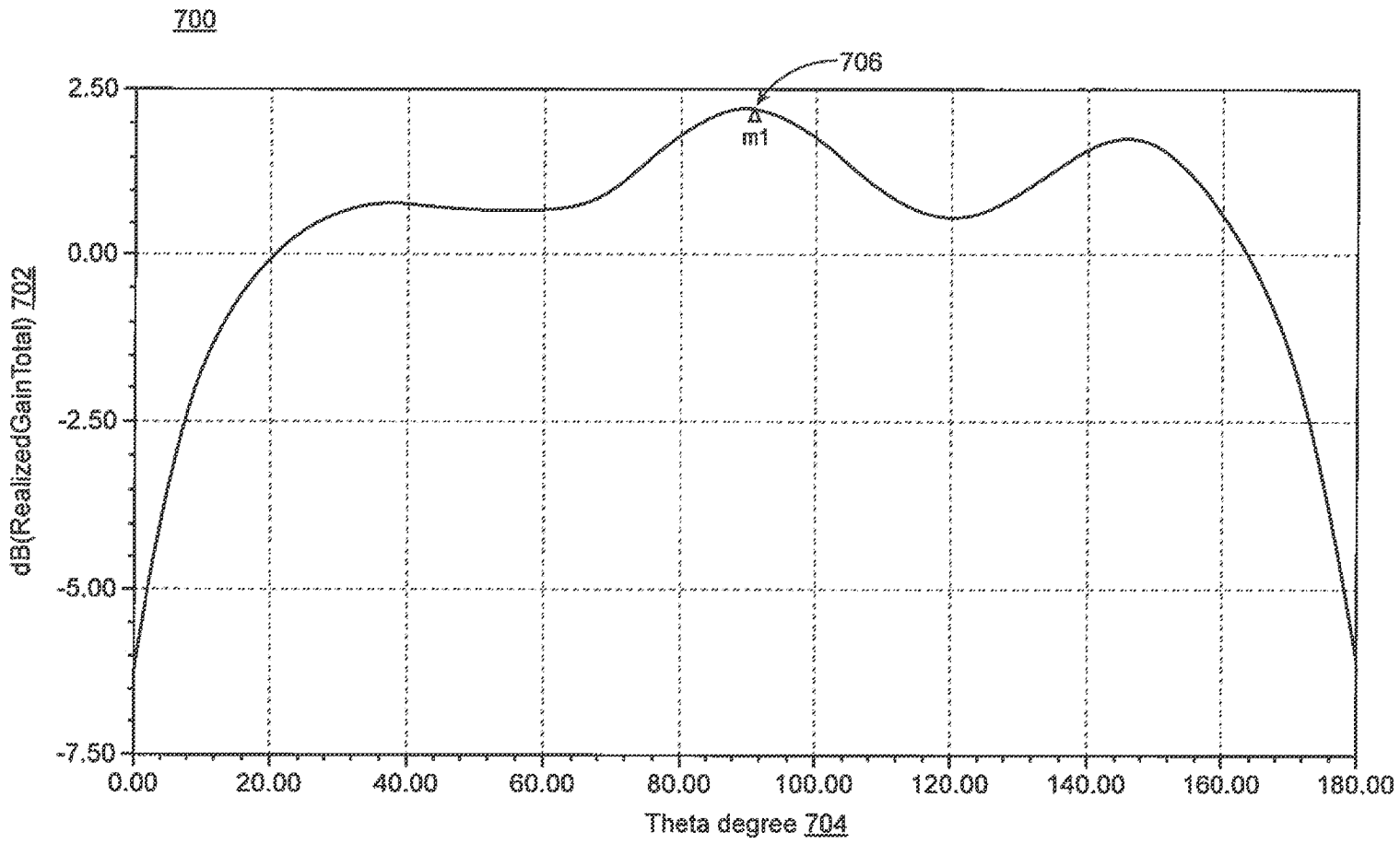
FIG. 7 displays a gain versus theta (degree) plot for the exemplary conformal antenna of the present technology.

FIG. 7 displays a graph 700 including a gain 702 versus theta (degree) 704 plot for the exemplary conformal antenna of the present technology. The gain of the conformal antenna depicts how much it radiates in decibel (dB) as compared to a lossless isotropic antenna. The beam-width illustrates the view angle of the conformal antenna which can be up to 360 deg. The gain 706 of the conformal antenna is 2.1846 dB and the beam-width 708 is 153.03600 (not shown). This represents twice the gain obtained from a lossless isotropic antenna having the same input power.

Figure 8:
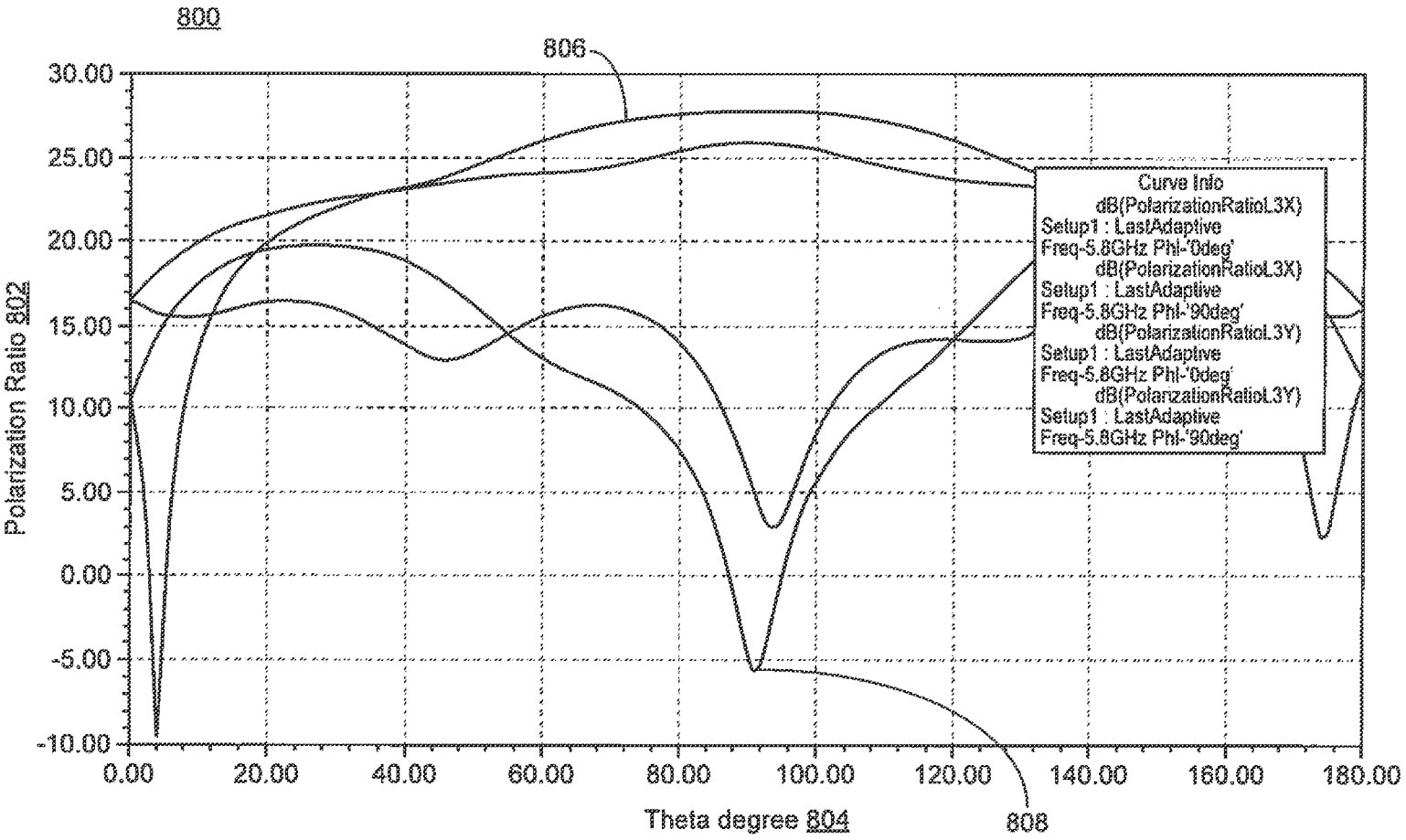
FIG. 8 displays a plot of the co-polarization and cross polarization versus angle in degrees for the exemplary conformal antenna of the present technology.

FIG. 8 displays a graph of the co-polarization and cross polarization 802 versus angle theta 804 in degrees for the exemplary conformal antenna of the present technology. The cross polarization should be 0 dB or negative for the conformal antenna to perform with optimum quality of signal strength and quality of signal. The polarization ratio plot gives co-polarization 806 and cross-polarization 808 values of +28 dB and −5.5 dB, such that the cross-polarization is less than 0 dB, which results in minimum interference.

Figure 9A:
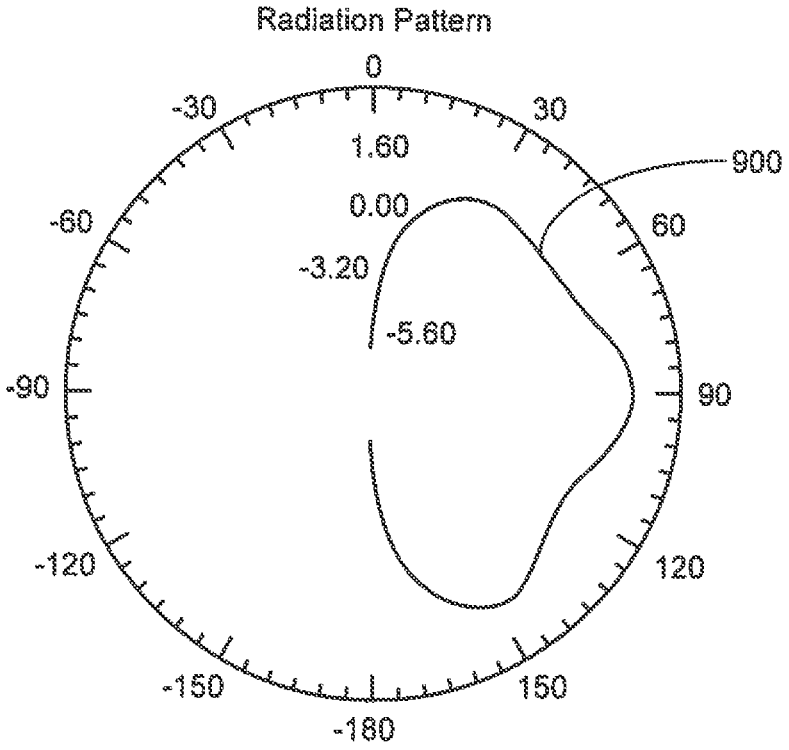
FIGS. 9A and 9B illustrate a 2-dimensional (2D) and a 3-dimensional (3D) radiation pattern for the conformal antenna of the present technology, respectively. The Radiation pattern shows how the signals propagates in to the air after leaving the patch surface in 2D and 3D respectively, for the antenna operating in C-band.
Figure 9B:
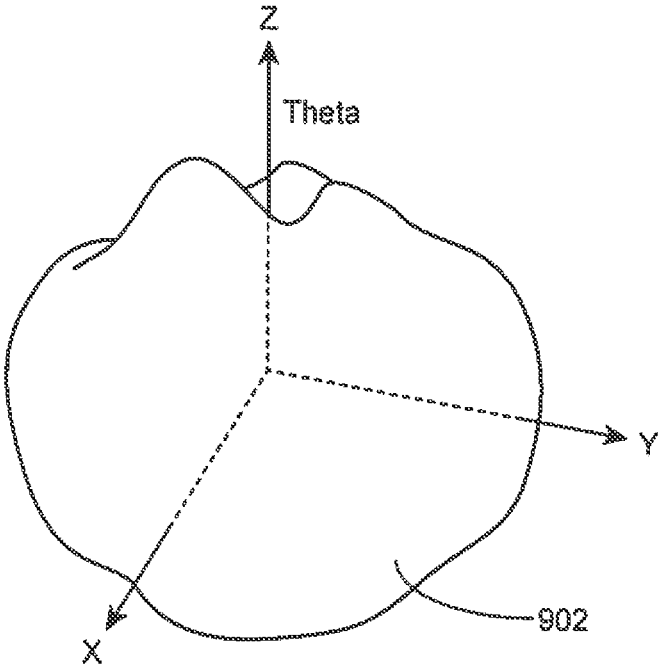

FIGS. 9A and 9B illustrate a 2-dimensional (2D) radiation pattern 900 and a 3-dimensional (3D) radiation pattern 902 for the conformal antenna of the present technology, respectively. The radiation patterns illustrate how the signals propagate into air after leaving the patch surface for the conformal antenna of the present technology operating in the C-band frequency range.

Accordingly, this technology provides a number of advantages including providing a conformal antenna and methods of designing a conformal antenna that solve problems related to signal reflection, antenna size, and unwanted radiations, while maintaining comparable gain, providing less spurious radiations, and operating in C-band frequency to be able to sustain adverse weather conditions. The conformal antenna further provides a compact, easy fabricate design that provides 360 degree coverage, higher gain, wider beam width, a lower voltage standing wave ratio (VSWR), excellent co-polarization, and negative cross polarization. The conformal antenna further reduces drags, either hydro or aero, and increases signal reception or signal radiation.

Having thus described the basic concept of this technology, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of this technology. Additionally, the recited order of processing elements or sequences, or the use of numbers, letters, or other designations therefore, is not intended to limit the claimed processes to any order except as may be specified in the claims. Accordingly, this technology is limited only by the following claims and equivalents thereto.

What is claimed is:

1. A conformal antenna comprising:

a dielectric substrate;

a plurality of circular micro strip antenna patches arranged on the dielectric substrate and coupled to a coaxial feed circuit, wherein the conformal antenna is configured to operate in a frequency range of about 4.0 GHz to about 8.0 GHz;

a memory for storing a plurality of weights;

a controller coupled to the memory, wherein the controller is configured to assign each of the plurality of weights to a corresponding one of the plurality of circular micro strip antenna patches for balancing a signal received from each of the plurality of circular micro strip antenna patches and generate a weight-adjusted signal;

a summation circuit coupled to the controller and the memory for receiving the weight-adjusted signals and configured to sum the weight-adjusted signals and output a summed signal;

a frequency controller circuit coupled to the summation circuit to receive the summed signal and configured to provide an output signal in the frequency range of about 4.0 GHz to about 8.0 GHz; and an adaptive filter coupled to the frequency controller circuit, the adaptive filter configured to receive the output signal and apply one or more adaptive algorithms to output a first portion of the output signal and to provide a second portion of the output signal to a feedback loop.

2. The conformal antenna of claim 1, wherein the dielectric substrate is spherical, cylindrical, or conical in shape.

3. The conformal antenna of claim 1, wherein the plurality of circular micro strip antenna patches are arranged on the dielectric substrate to provide a beam width of 360 degrees to the conformal antenna.

4. The conformal antenna of claim 1, wherein the plurality of circular micro strip antenna patches are smart skin antennas.

5. The conformal antenna of claim 1, wherein the plurality of circular micro strip antenna patches are arranged in a micro strip array.

6. The conformal antenna of claim 1, wherein the feedback loop is coupled to the adaptive filter, the summation circuit, and the controller and the memory, wherein the feedback loop comprises an error estimation circuit configured to provide adjustments to the summation circuit and the plurality of weights.

7. A method of designing a conformal antenna, the method comprising:

selecting, by an antenna design management computing device, a dielectric substrate;

selecting, by the antenna design management computing device, a desired operating frequency range for the conformal antenna, wherein the desired operating frequency is in a range of about 4.0 GHz to about 8.0 GHz;

designing, by the antenna design management computing device, a circular micro strip antenna patch based on at least a dielectric constant, a height of the dielectric substrate, and the desired operating frequency, wherein the circular micro strip antenna patch is configured to conform to the shape of the dielectric substrate; and determining, by the antenna design management computing device, a number of the circular micro strip antenna patches to be applied on the dielectric substrate based on at least the surface area of the dielectric substrate and the surface area of the circular micro strip antenna patch;

assigning, by the antenna design management computing device, a plurality of weights to a corresponding one of a plurality of circular micro strip antenna patches for balancing a signal received from each of the plurality of circular micro strip antenna patches to generate a weight-adjusted signal corresponding to each of the plurality of circular micro strip antenna patches;

performing, by the antenna design management computing device, a summation of the generated weight-adjusted signals to provide a summed signal, wherein the summation is performed by a summation circuit that receives the generated weight-adjusted signals;

coupling, by the antenna design management computing device, a frequency controller circuit to the summation circuit to receive the summed signal, wherein the frequency controller circuit is configured to provide an output signal in the frequency range of about 4.0 GHz to about 8.0 GHz; and coupling, by the antenna design management computing device, an adaptive filter to the frequency controller circuit for receiving the output signal and applying one or more adaptive algorithms to output a first portion of the output signal and to provide a second portion of the output signal to a feedback loop.

8. The method of claim 7, wherein the dielectric substrate is spherical, cylindrical, or conical in shape.

9. The method of claim 8 further comprising:

arranging a plurality of the circular micro strip antenna patches on the dielectric substrate to provide a beam width of 360 degrees to the conformal antenna.

10. The method of claim 9, wherein the plurality of circular micro strip antenna patches are smart skin antennas.

11. The method of claim 7 further comprising:

providing adjustments to the summation circuit and the plurality of weights based on a feedback loop coupled to the adaptive filter and the summation circuit.

12. The method of claim 7, wherein each of the plurality of circular micro strip antenna patches has an optimized effective radius of about 9.5 mm, wherein the optimization is based on at least the dimensions of the selected dielectric, the frequency of operation of the conformal antenna.

13. The method of claim 7, wherein the dimensions of the selected dielectric are determined based optimization performed by simulating the conformal antenna characteristics for minimizing at least spurious radiations.

* * * * *